United States Patent [19]

Bunch, Jr.

[11] Patent Number: 4,522,619

[45] Date of Patent: Jun. 11, 1985

[54] TIMING ADJUSTMENT MECHANISM FOR CONTINUOUS FORM STATIONERY FOLDING MACHINE

[76] Inventor: Earnest B. Bunch, Jr., 7016 W. Astor Rd., Peoria, Ariz. 85345

[21] Appl. No.: 115,705

[22] Filed: Jan. 28, 1980

[51] Int. Cl.[3] ..... B65H 45/20

[52] U.S. Cl. ..... 493/415

[58] Field of Search ..... 270/39, 61 F, 79, 73; 493/415

[56] References Cited

U.S. PATENT DOCUMENTS

| | | | |
|---|---|---|---|
| 2,098,427 | 11/1937 | Menschner . | |
| 2,761,678 | 9/1956 | Cohn et al. . | |
| 3,086,768 | 4/1963 | Lach . | |
| 3,109,643 | 11/1963 | Zimmerman . | |
| 3,124,350 | 3/1964 | Huffman . | |
| 3,150,872 | 9/1964 | Lockwood et al. . | |
| 3,248,105 | 4/1966 | Southwell et al. . | |
| 3,499,643 | 3/1970 | Bigger | 493/415 |
| 3,717,335 | 2/1973 | Faltin . | |
| 3,762,698 | 10/1973 | Thomas | 270/73 |
| 3,912,252 | 10/1975 | Stephens | 270/79 |
| 4,204,669 | 5/1980 | Nystrand | 270/73 |

FOREIGN PATENT DOCUMENTS

| | | | |
|---|---|---|---|
| 2258338 | 8/1975 | France | 270/61 F |

*Primary Examiner*—A. J. Heinz

*Attorney, Agent, or Firm*—Drummond & Nissle

[57] ABSTRACT

Improved apparatus for producing continuous form stationery by folding a strip of paper along lines of weakening formed therein. The apparatus includes a frame, a distributing mechanism mounted on the frame for alternately distributing successive lines of weakening in the paper in substantially opposite directions, dispensing rollers carried on the frame for dispensing the continuous strip of paper into the distributing mechanism, folding mechanisms carried by the frame for urging the paper into a folded condition, a gear train for transmitting motive power to the dispensing rollers, the distributing mechanism, and the folding mechanisms, and a power unit to drive the gear train. The gear train includes at least one drive shaft transmitting motive power only to the portion of the gear train actuating the distributing and folding mechanisms. The improvement consists of positioning a differential unit along the drive shaft so that the timing of the distributing and folding mechanisms may be adjusted in relation to the timing of the dispensing rollers.

1 Claim, 9 Drawing Figures

TIMING ADJUSTMENT MECHANISM FOR CONTINUOUS FORM STATIONERY FOLDING MACHINE

This invention relates to improved apparatus for producing continuous form stationery by folding a strip of paper along transverse lines of weakening formed therealong.

More particularly, the invention concerns an improved stationery folding machine of the type having a dispensing roller which directs a continuous strip of paper into a mechanism which distributes successive lines of weakening formed in the paper in substantially opposite directions and having additional mechanisms for creasing the distributed paper along the lines of weakening to produce continuous form stationery.

In another respect, the invention concerns an improved paper folding machine of the type having a dispensing roller, distributing mechanism and accompanying paper folding mechanisms which operate in generally fixed proportional synchronous relationship such that for a given rate of production by the paper folding machine the dispensing roller, distributing mechanisms and accompanying folding mechanisms each have a specific fixed operational speed.

In a further aspect, the invention relates to an improved paper folding machine which has an improved mechanism for adjusting the timing of the distributing unit and accompanying paper folding mechanisms in relation to the dispensing roller mechanism while the paper folding machine either is or is not being operated.

In a still further respect, the invention relates to an improved paper folding machine which has an improved mechanism for adjusting the timing of the distributing unit and accompanying paper folding mechanisms while maintaining the synchronous relationship thereinbetween.

In still another aspect, the invention relates to an improved paper folding machine having a lower power requirement because of reduced frictional losses in the mechanism for adjusting the timing of the distributing unit and other paper folding mechanisms in relation to the dispensing roller mechanism.

In yet another respect, the invention relates to an improved timing adjustment apparatus which functions with increased accuracy and which better maintains a particular adjustment position because of reduced backlash or slack in the improved adjustment apparatus.

The general type of paper folding machine described in U.S. Pat. No. 3,086,768, to Lach, has achieved wide commercial acceptance since it was introduced in the market. While the apparatus described in the Lach Patent has undergone substantial improvements, the basic operational combination still consists of dispensing rollers for supplying a strip of paper to a distributing unit which spreads the paper in a zig-zag fashion and of other moving mechanisms for compressing and generally placing horizontal tension on the paper to form folds along the lines of perforation or weakening formed in the material. During operation of the paper folding machine the distributing unit, dispensing rollers and accompanying paper folding mechanisms operate in generally fixed proportional synchronous relationship so that for a given rate of production by the paper folding machine the dispensing rollers, distributing mechanism and accompanying folding mechanisms each have a specific fixed operational speed. The distributing unit, accompanying folding mechanisms and dispensing roller unit are provided with motive power by a common gear train. Before such a paper folding machine is operated, the distributing unit and other mechanisms for folding the paper are adjusted and positioned in relation to the location of the lines of weakening along the strip of material being fed into the machine. In operation, successive lines of weakening must be placed by the distributing unit essentially parallel to and at equal distances to either side of the axis of rotation of the oscillating distributing mechanism. If successive lines of perforation are placed at varying distances to either side of the axis of rotation of the distributing unit, operational efficiency is reduced and the apparatus may not be operated at its optimal speed.

The strip of material or "webbing" fed into the distributing unit is pulled by the dispensing rollers from a large roll of paper mounted to the rear of the paper folding apparatus. Typically, regardless of the care taken by the operator in initially setting up the machine, material pulled over the dispensing roller and directed into the distributing unit will not be completely taut when the machine is initially started. This causes successive lines of weakening to be distributed at varying distances from the axis of rotation of the distributing unit, and the operator either has to stop and further adjust the machine or operate the machine at a lower than optimal rate of speed.

Apparatus has been developed which allows the timing of the distributing unit and other accompanying paper folding mechanisms to be adjusted while the paper folding machine is being operated. As will be later described, one such device was attached or inserted into the gear train which provides motive power to the distributing unit and accompanying paper folding mechanisms. During operation of the prior art unit, motive power was transferred from one toothed gear to the differential unit and then from the differential unit back into the original drive train through another toothed gear. While this device allowed adjustment of the timing of the oscillating distributing unit and accompanying folding mechanisms during operation of the paper folding machine, the device included at least 14 moving parts and 2 continuous timing belts. This combination of belts and of a sizeable number of moving parts resulted in substantial backlash or slack in the gear system so that it was difficult to make accurate, fixed adjustments in the timing of the distributing unit and accompanying paper folding mechanisms. The backlash in this known apparatus was at least partially inherent in attempting to interpose the differential unit in the gear train by transferring motive power from one toothed gear in the train to the differential timing adjustment device and then from the timing device back to a second toothed gear in the gear train. In particular, placing the timing adjustment unit in this position accentuated the alteration of the operating characteristics of the apparatus at high speeds and made the machine more susceptible to moving off of or "traveling" from a given adjustment position. When the paper folding machine travels from an adjustment position and the lines of weakening formed along the strip of paper are distributed at unequal distances from the axis of rotation of the distributing unit, the distributing unit and folding mechanisms should be readjusted; however, normally the machine operator will not want to take the time to stop and readjust the machine and will instead continue to run the machine at less than optimal operational speed.

Therefore, it would be highly desirable to provide improvements in paper folding machines of the type described above which would allow precise adjustment of the synchronous timing of the distributing unit and accompanying folding mechanisms in relation to the dispensing roller mechanism which provides paper to the distributing unit.

It would also be highly desirable to provide improvements in paper folding machines of the type described which would lead to reduced power requirements, increased longterm mechanical reliability, and increased operational speed.

Accordingly, it is the principal objective of the present invention to provide improved apparatus for folding a strip of paper along transverse lines of weakening formed therealong into a strip of continuous form stationery having zig-zag folds therein.

Another principal objective of the present invention is to provide an improved paper folding machine of the type having a distributing unit for directing successive lines of weakening along a strip of paper in substantially opposite directions for folding by accompanying paper folding mechanisms, and having a dispensing roller unit for providing the distributing unit with a continuous strip of paper.

Still another objective of the invention is to provide an improved paper folding machine of the type described having an improved mechanism for adjusting the timing of the distributing unit and accompanying paper folding mechanism in relation to the incoming lines of weakening in the paper provided by the dispensing roller mechanism.

Another objective of the instant invention is to provide an improved paper folding machine of the type described having an improved mechanism for adjusting the timing of the paper distributing unit and accompanying paper folding mechanisms without disturbing the synchronous relationship thereinbetween.

Still another and further objective of the invention is to provide an improved paper folding machine and timing adjustment device having increased mechanical reliability, reduced power requirements, and improved adjustment accuracy.

These and other and further more specific objectives and advantages of the invention will be apparent to those skilled in the art from the following detailed description and the drawings. For the purpose of illustrating the invention, the detailed description set forth below and the drawings depict the invention as employed in a specific type of paper folding machine, a "spiral" paper folding machine. However, as will be apparent to those skilled in the art, the improved timing adjustment apparatus described below as being included in the spiral paper folder will be similarly applicable in any other type of paper folding machine wherein a portion of a gear train including a drive shaft actuates paper folding or distributing mechanisms which must be synchronized with dispensing rollers which provide a continuous strip of paper to the paper folding or distributing mechanism.

Briefly, in accordance with the presently preferred embodiment of my invention, I provide an improved apparatus for producing continuous form stationery by folding a strip of paper along transverse lines of weakening formed therein. The apparatus includes a frame, means mounted on the frame for alternately distributing successive lines of weakening in the paper in substantially opposite directions, roller means carried on the frame for dispensing the continuous strip of paper into the distributing means, means carried by the frame for urging the paper into a folded condition, gear train means for transmitting motive power to the roller means, the distributing means and the urging means such that generally synchronized movement thereinbetween is maintained, and power means to drive the gear train means. The gear train means has at least one drive shaft transmitting motive power only to that portion of the gear train means actuating the distributing means and urging means. The improvement comprises differential means, integrated with and separating the drive shaft into a first shaft portion and a second shaft portion, for rotating the first shaft with respect to the second shaft so that the timing of the distributing means and urging means may be adjusted in relation to the roller means.

Figure 1:
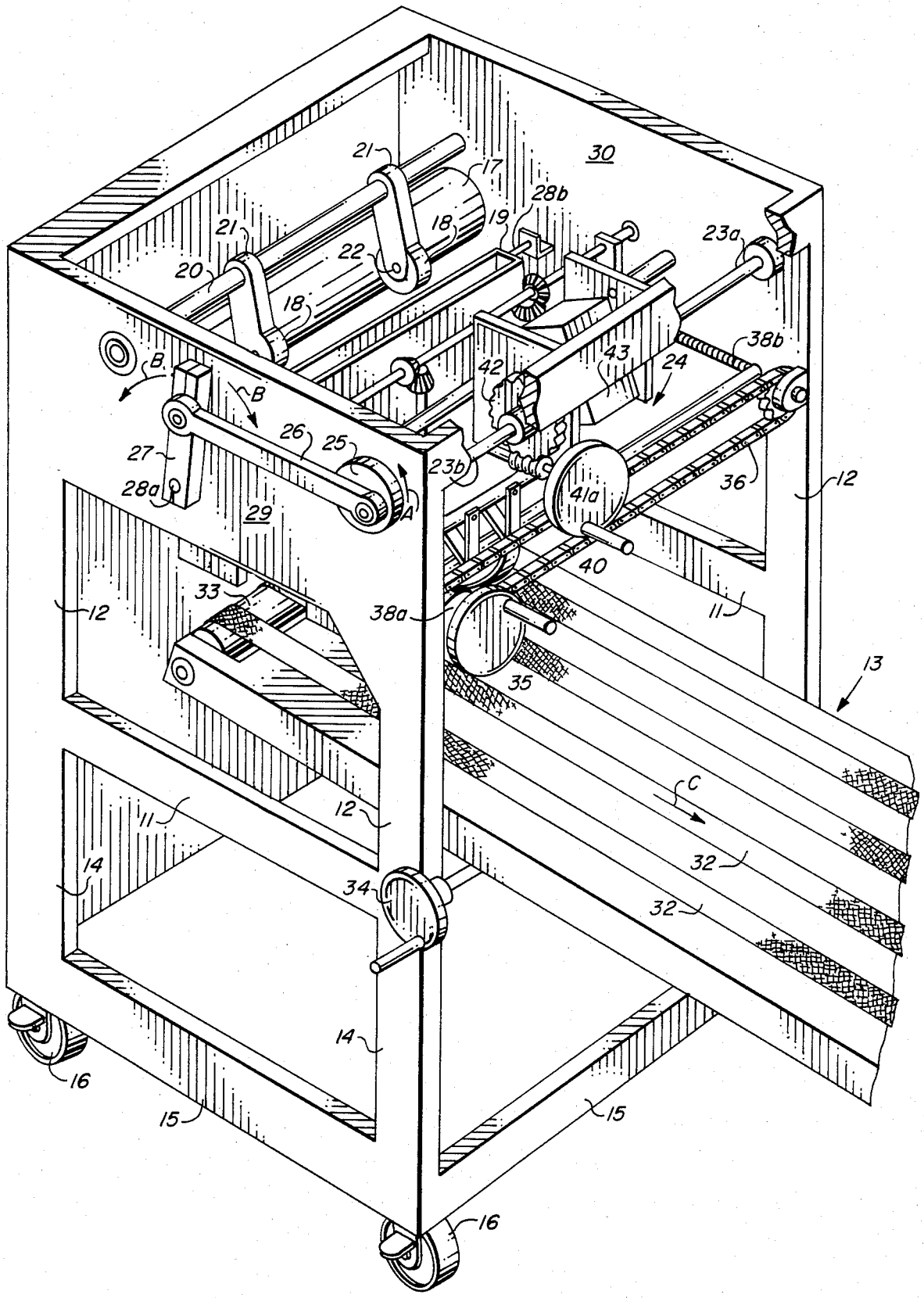
FIG. 1 is a perspective view of an improved spiral paper folding machine which includes the timing adjustment apparatus of the invention.

Turning now to the drawings, which depict the presently preferred embodiment of the invention for the purpose of illustrating the practice thereof and not by way of limitation of the scope of the invention and in which like reference characters identify corresponding parts in the several views, FIG. 1 is a perspective view showing the general arrangement of the elements. A frame consisting of horizontal members 11 and vertical members 12 supports conveyor table 13 and various paper folding mechanisms which will be subsequently described. If desired, the frame 11–12 may be further provided with suitable support legs 14 and associated horizontal members 15 mounted on casters 16 to raise the entire apparatus to a convenient working height and to provide for moving the machine within a work area.

A continuous strip of paper or other material is drawn by dispensing roller 17 beneath roller guides 18 and directed into chute 19. Dispensing roller 17 is carried on axle 71*a* (not visible in FIG. 1) journalled for rotation in panels 29 and 30. The axle is rotated by the gear train of the apparatus. Roller guides 18 are secured to rod 20 by sleeves 21 provided with axles 22.

A pair of drive shafts 23*a* and 23*b* are integrated with the differential mechanism which is generally indicated by reference character 24. Shaft 23*b* rotates gear 25 in the direction of arrow A causing link 26 to reciprocate arm 27 in the directions of arrows B. Arm 27 is fixedly secured to shaft 28 which is attached to chute 19 and journalled for rotation in panel 29. An identical shaft 28 is affixed to the opposite side of chute 19 and is journalled for rotation in panel 30.

Transverse lines of weakening along material entering chute 19 are distributed in substantially opposite directions as chute 19 oscillates and, as later described, the material is compressed and folded by "beaters" and "spirals" (not visible in FIG. 1). Continuous moving belts 32 carried by roller 33 carry the folded paper away from the folding mechanisms in the direction of arrow C. The slope of conveyor table 13 is adjusted by turning handle 34.

Threaded shafts 38*a* and 38*b* each carry a sprocket 37 which engages continuous chain 36. By turning handle 35 shaft 38*a* is rotated causing the teeth of sprocket 37 to engage and turn continuous chain 36 so that sprocket 37 and shaft 38*b* simultaneously rotate. Rotation of shafts 38*a* and 38*b* horizontally adjusts the positions of the beaters, spirals and paper stops (not visible).

Differential mechanism 24 includes handle 40 for rotating shaft 41 which is provided with worm gear 41*a* engaging ring gear 42 fixedly attached to spider 43. As would be apparent to those skilled in the art, handle 40 may be turned while drive shafts 23*a* and 23*b* are rotated or are motionless so that the position of a particular point on shaft 23*b* may be rotated in relation to a point on shaft 23*b*. When handle 40 is not used to adjust the relative position of shafts 23*a* and 23*b*, the differential functions as an idler, allowing each shaft to turn at identical rpm.

Figure 2:
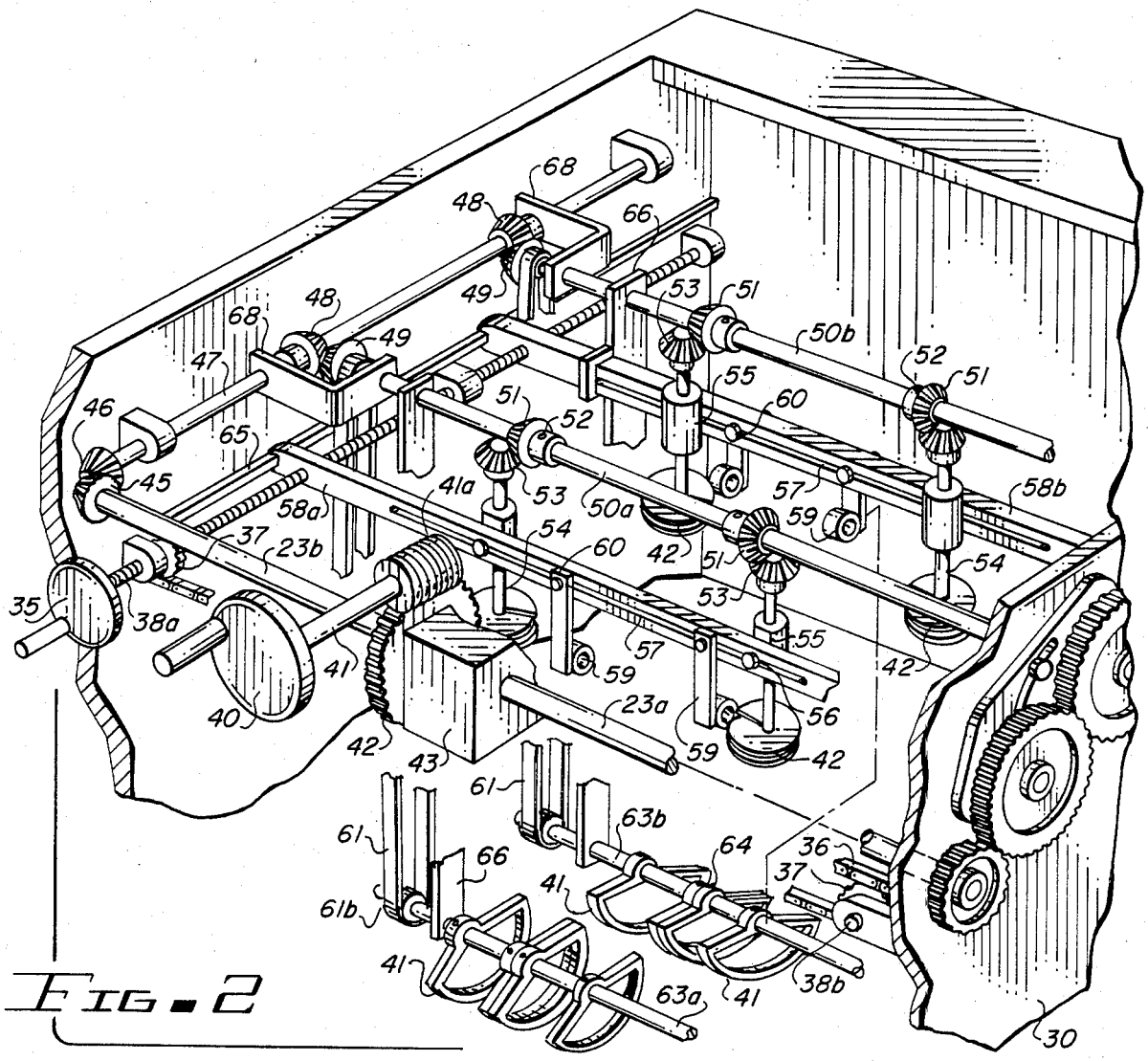
FIG. 2 is an enlarged partial perspective view of the improved spiral paper folding machine of FIG. 1 illustrating details of the paper folding mechanism and associated drive train.

FIGS. 2–7 illustrate the interrelation of the beaters 41, spirals 42, chute 19 and gear train of the apparatus. As shown in FIG. 2, drive shaft 23*b* is provided with pinion gear 45 which drives gear 46 to rotate shaft 47 and bevel gears 48 mounted thereon. Gears 48 drive bevel gears 49 to rotate shafts 50 and gears 51 which are secured to shaft 50 by setscrews 52. Pinion gears 51 turn beveled gears 53 to rotate shafts 54 and spirals 42. Shafts 54 are journalled for rotation in sleeves 55 which are provided with set screws 56 for transversly adjusting the position of spirals 42 along slots 57 in support bars 58. Paper stops 59 are also fixedly adjustably attached to bars 58 by set screws 60.

When shafts 50 are rotated, continuous belts 61 mounted on rollers 61*a* and 61*b* affixed to rods 50 and 63 turn and simultaneously rotate shafts 61 on which beaters 41 are adjustably mounted. Set screws 64 permit beaters 41 to be positioned along shafts 63.

When threaded shafts 38*a* and 38*b* are rotated by turning handle 35, support bars are moved along rails 65 horizontally positioned on the interior of panels 29 and 30. Member 66*a* interconnects the left hand ends of shaft 50*a*, bar 58*a* and rod 63*a* so that when threaded rods 38*a* and 38*b* are rotated shaft 50*a*, bar 58*a* and rod 63*a* move in unison. A second member 66*a* (not visible) interconnects the right hand ends of shaft 50*b*, bar 58*b* and rod 63*b* so that when threaded rods 38*a* and 38*b* are rotated shaft 50*b*, bar 58*b* and rod 63*b* move in unison. A second member 66*b* (not visible) interconnects the right hand ends of shaft 50*b*, bar 58*b* and rod 63*b*. When the position of bars 58*a* and 58*b* are adjusted along threaded rods 38*a* and 38*b* gears 48 slide along rod 47. L-shaped brackets 68 function to keep pinion gears 48 meshed with gears 49.

Figure 3:
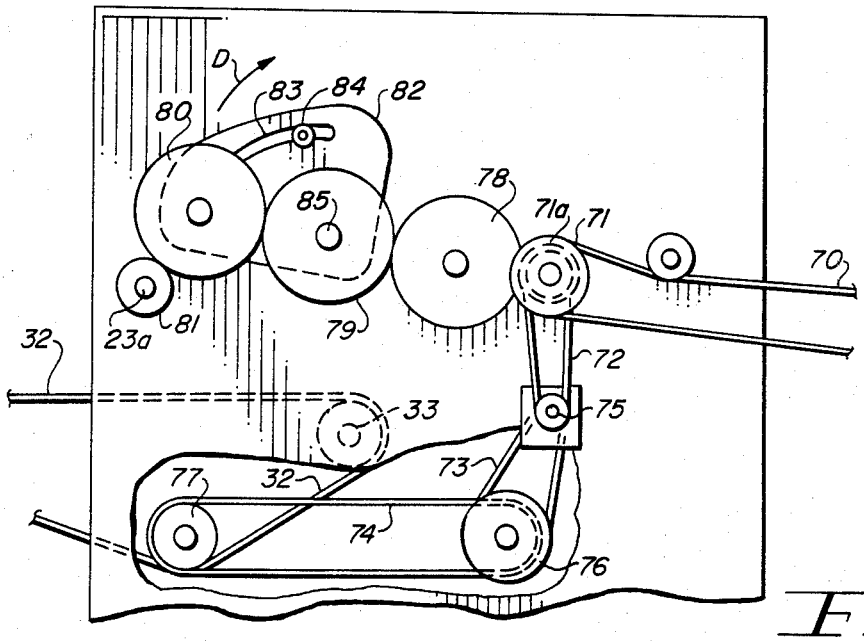
FIG. 3 is a schematic drawing of the righthand side of the paper folding machine of FIG. 1 illustrating the drive mechanism which activates the paper dispensing roller and further transmits motive power to that portion of the gear train activating the paper folding and distributing mechanisms.
Figure 4:
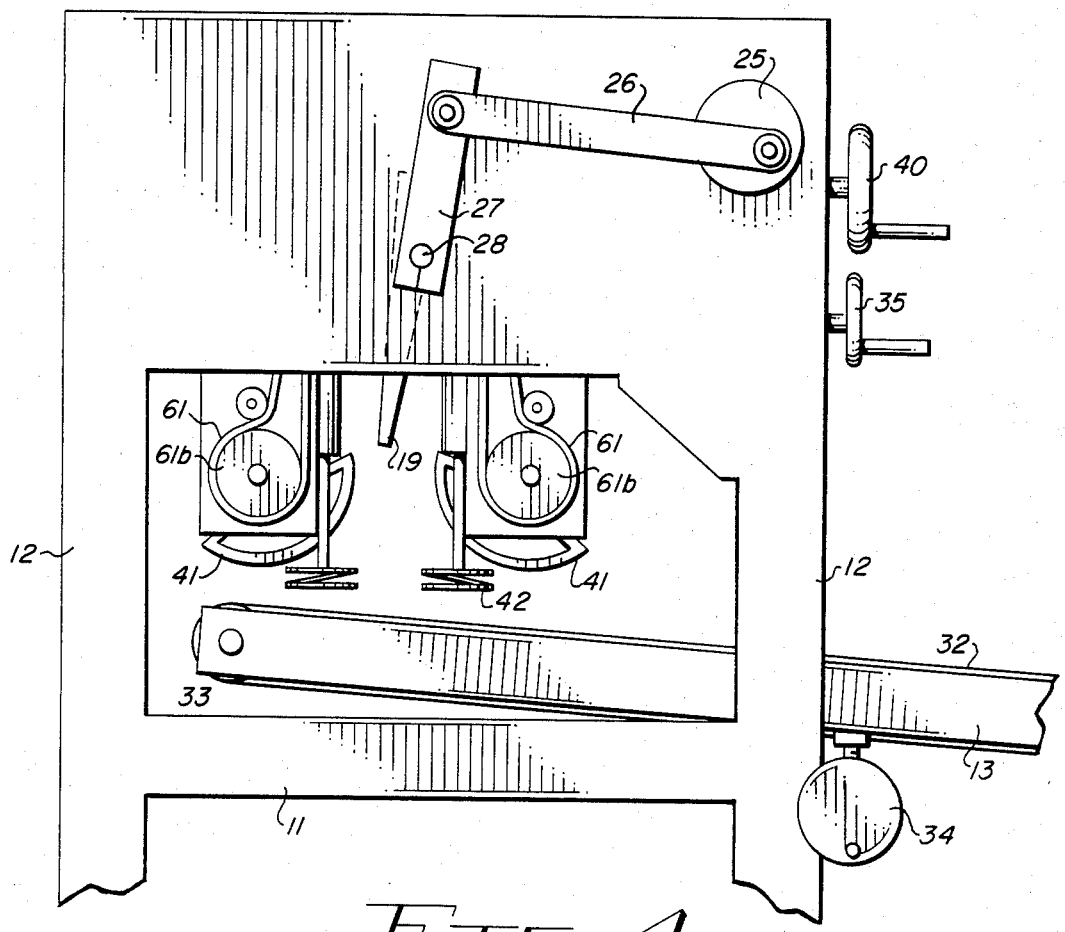
FIG. 4 is a left side elevational view of the improved spiral paper folder of FIG. 1.

As shown in FIG. 3 belt 70 from power means (not shown) which drive the gear train actuates gear 71. Continuous belts 72, 73 and 74 transmit power to conveyor belts 32 of table 13 through pulley gear 75 and rollers 76, 77. Motive power from gear 71 is transmitted through sector gears 78, 79, and 80 to removable toothed gear 81. Gear 80 is attached to plate 82 having slot 83 formed therein and which is rotatably mounted on rod 85. In order to remove gear 81 from shaft 23*a*, gear 80 is upwardly lifted in the direction of arrow D by loosening set screw 84 in slot 83. Depending on the distance between successive lines of weakening in the paper being folded various sized gears 81 are used to rotate drive shaft 23*a*.

Figure 5:
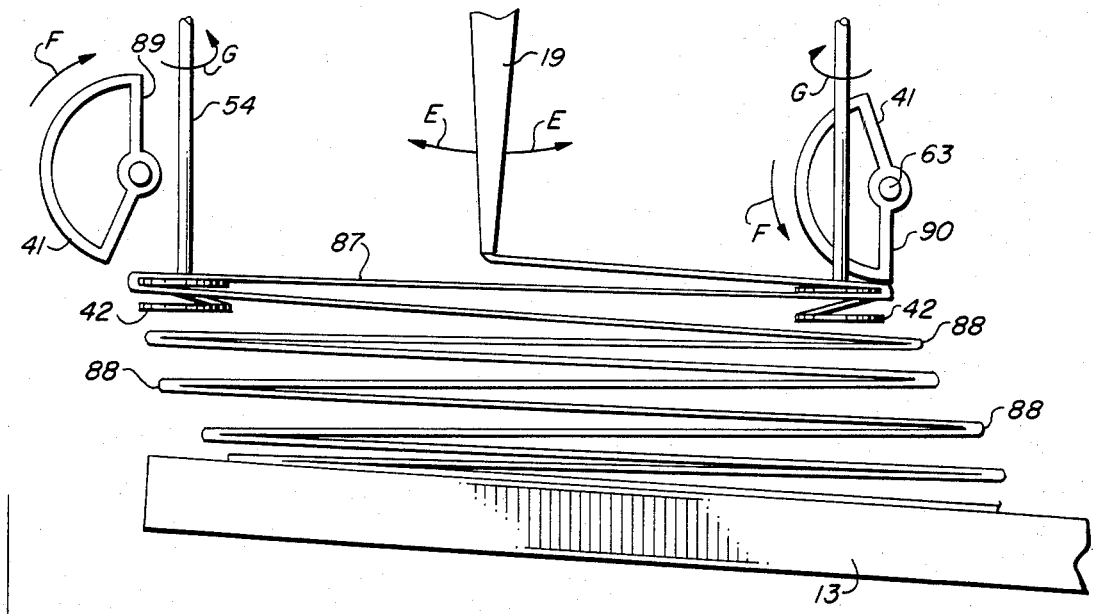
FIG. 5 is a schematic view of the improved spiral paper folder of FIG. 4 showing the interrelationship between the paper folding mechanisms therein.
Figure 6:
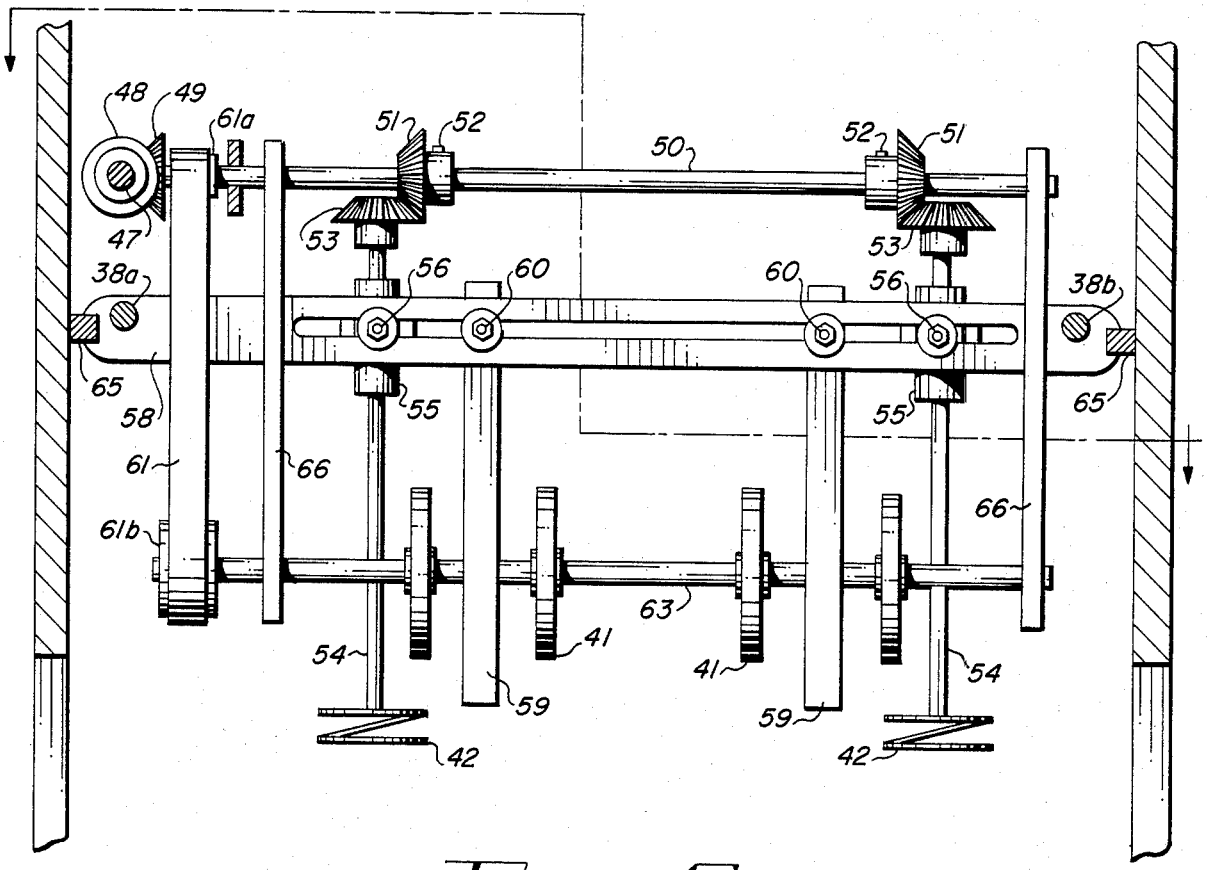
FIG. 6 is a front view of a portion of the spiral paper folding machine of FIG. 1 illustrating further details of the paper folding mechanisms and associated gearing thereof.
Figure 7:
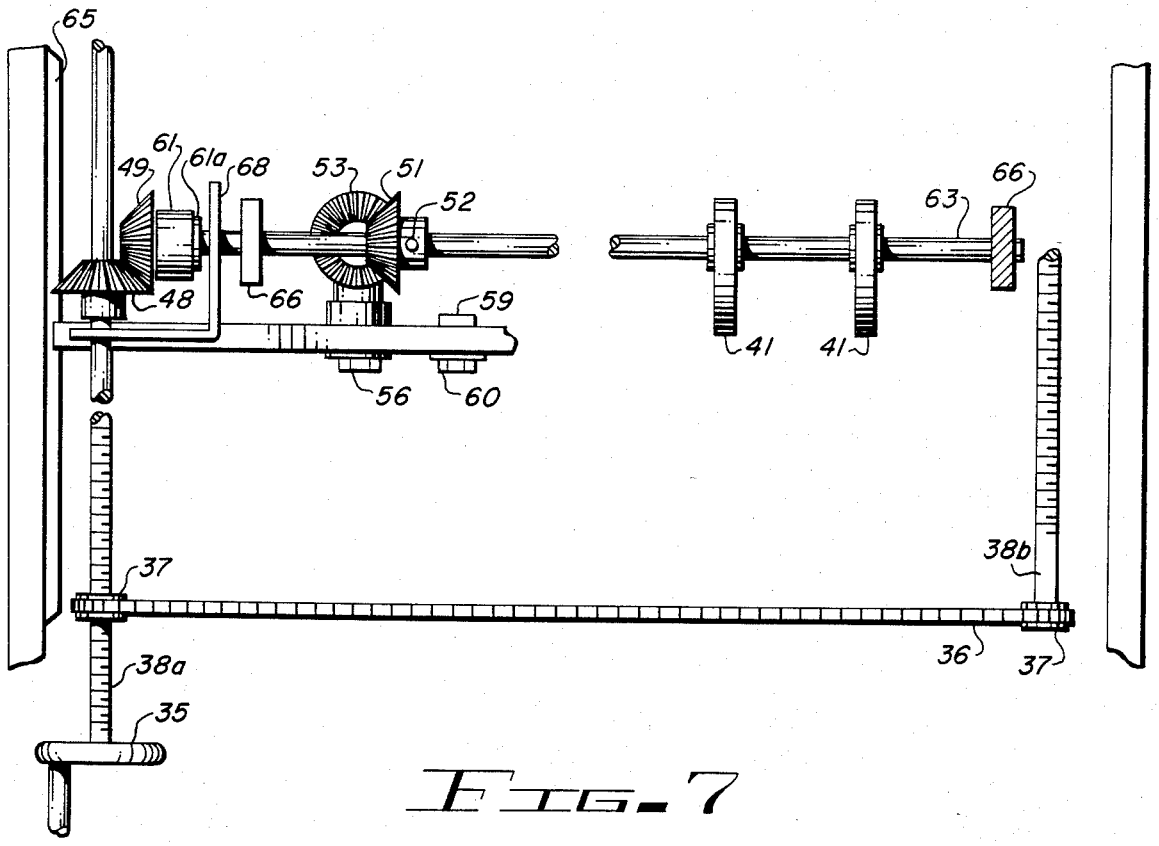
FIG. 7 is a top view of a portion of the spiral paper folder of FIG. 1.
Figure 8:
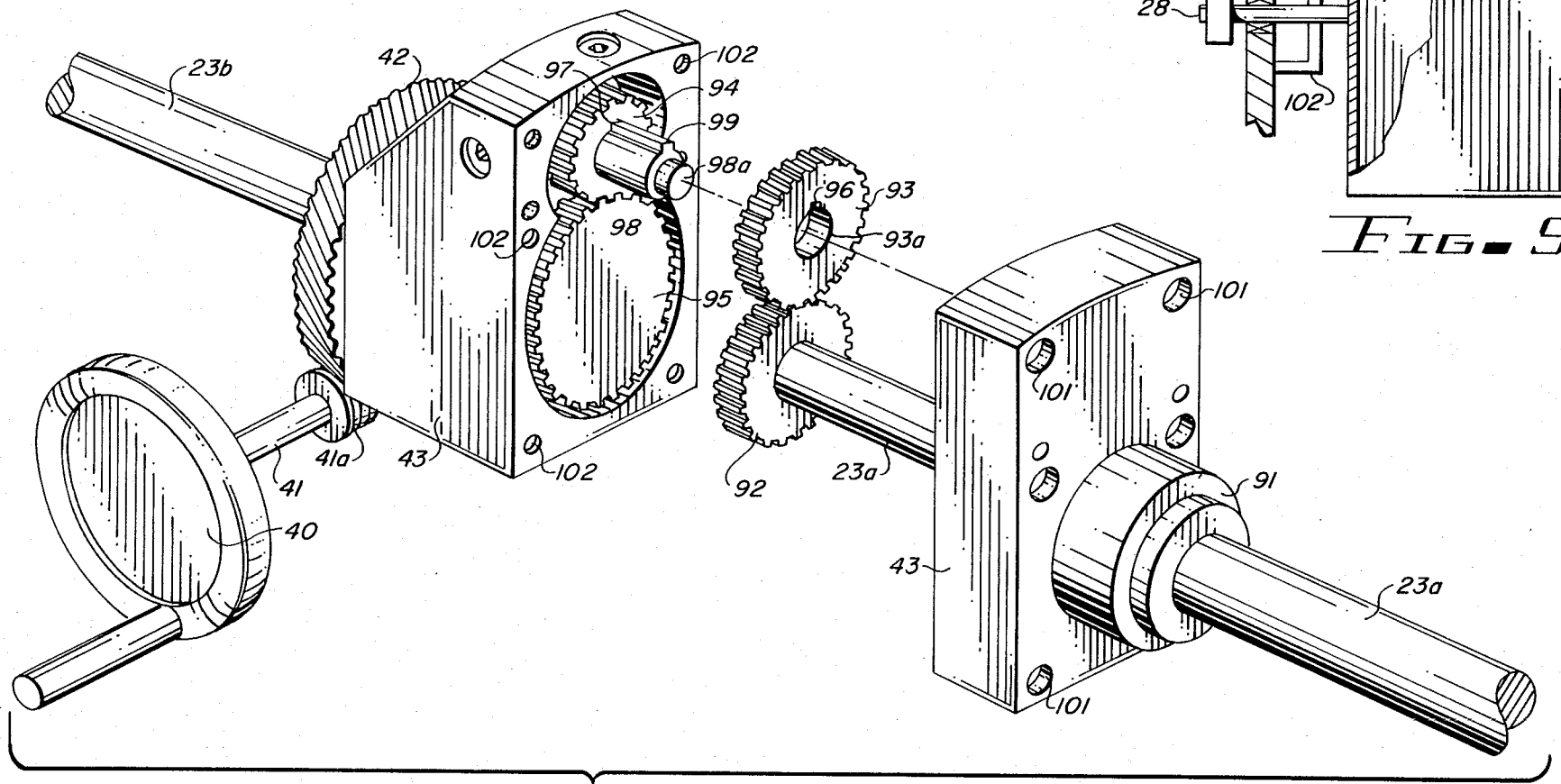
FIG. 8 is a perspective schematic assembly view of the improved differential timing adjustment mechanism of the instant invention.

The schematic diagram in FIG. 5 illustrates the synchronous relationship of the chute 19, beaters 41 and spirals 42 as they respectively move in the directions indicated by arrows E, F and G. When lines of weakening formed in the strip of paper are distributed in opposite directions by the chute 19, beaters 41 and spirals 42 compress material 87 to form folds 88. Ideally the beaters 41 strike the upper surface of material 87 one half to two inches behind the lines of weakening along which the paper is folded. The chute and beaters are synchronized such that when the chute is essentially at the midpoint of its oscillation arc, as shown in FIG. 5, the surfaces 89 and 90 of beaters 41 mounted on their respective shafts 63 are in the positions shown in FIG. 5. Similarly when the chute 19 and beaters 41 are in the positions illustrated in FIG. 5 a given point on the periphery of each spirals 42 is in a particular position As illustrated in the schematic assembly diagram of FIG. 8 the differential assembly 24 includes the adjustment handle 40 having throat 41 attached to worm gear 41*a* which actuates drive pinion 42 to turn spider 43. Drive shafts 23*a* and 23*b* are journalled for rotation in spider 43, with shaft 23*a* being carried by sleeve 91. The rotary motion of shaft 23*a* is transmitted through gears 92, 93, 94, and 95 to rotate drive shaft 23*b*. Slots 96 and 97 permit gears 93 and 94 to be fixedly mounted on shaft 98 having lip 99. Aperture 93*a* of gear 93 receives end 98*a* of rod 98. Apertures 94*a* and 95*a* in spider 43 respectively house gears 94 and 95. Similar circular apertures in the opposing half of spider 43 house gears 92 and 93. As would be appreciated by those skilled in the art the differential mechanism permits the rotation of shaft 23*b* to be "set ahead" or "set back" of that of shaft 23*a* while the shafts 23*a*, 23*b* are rotating or are motionless. Since the rotational movement of shaft 23*b* is transmitted along the gear train to the chute 19, beaters 41 and spirals 42, turning handle 40 effectively adjust the synchronized timing of the chute, beater and spirals in relation to the paper dispensing roller 17, or, in other words, in relation to the position of the lines of weakening in the paper as they pass through and are distributed by the chute 19. Nuts (not shown) provided for internally threaded apertures 101 and 102 secure the halves of spider 43.

Figure 9:
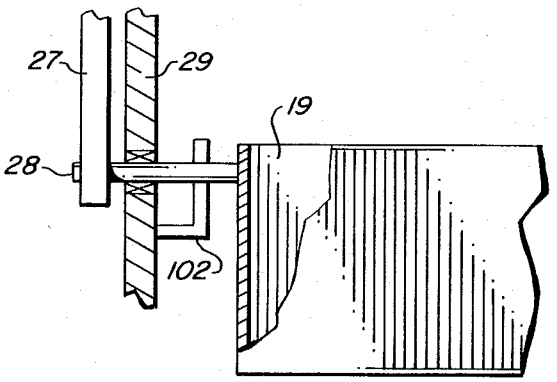
FIG. 9 is a front view of a portion of the spiral paper folding machine illustrating further details of a paper folding mechanism and gearing associated therewith.

As shown in FIG. 9, shaft 28 fixedly attached to chute 19 is journalled for rotation in panel 29 and L-shaped support bracket 102. A sister support bracket 102 provides additional support for shaft 19 as it enters panel 30 on the opposite end of the chute.

In operation, paper is fed into chute 19 at a particular rate by paper dispensing roller 17. As chute 19 distributes successive transverse lines of weakening in opposing directions beaters 41 and spirals 42 function to compress and crease the paper along the lines of weakening. Ideally, the beaters strike the upper surface of the paper being distributed within a range of one-half to two inches behind the lines of weakening or folded edge of the paper or other material. At various operational speeds the operational characteristics of the paper folding mechanisms may vary and the point at which the beaters strike the upper surface of the paper tends to "travel" to a position outside the preferred one-half to two inch range. In particular, at high operational speeds the chute is elastically deformed during its oscillation. This causes the lines of weakening to be distributed off center as previously described. By turning handle 40 shaft 23*b* may be rotated with respect to shaft 23*a* so that the timing of the chute, beaters, and spirals are simultaneously adjusted in relation to the timing of the dispensing roller such that the lines of weakening are again distributed equidistant from the chute axis of rotation. Differential timing mechanism 24 permits this adjustment to be made while maintaining the synchronous relationship of the chute, beaters and spirals.

The prior art differential mechanism was positioned above gears 78 and 79 (See FIG. 3) so that motive power was transmitted from gear 78 to the differential mechanism and then from the differential back to the original gear train through gear 79. This particular device had at least 14 moving parts and had resultant "backlash" equivalent to a positional change of one-quarter inch in the distance from the crease edge of the point at which the beaters contact paper distributed by the chute 19. The differential mechanism mounted to drive shafts 23*a* and 23*b* contains substantially fewer parts. This contributes to the adjustment accuracy of the mechanism and reduces the power required to drive the movable elements all leading to a less expensive machine having increased overall long-term reliability and accuracy.

The exact location of the electric motor or other power means which is used to operate the apparatus described above and the belt 70 (See FIG. 3) or other suitable power transfer means which connect the motor to the operational elements are not shown so as to avoid complication of the drawings. However, as suggested in FIG. 3, the machine motor could be positioned immediately to the rear of the paper folding machine or in a variety of other locations.

Having described my invention in such terms as to enable those persons skilled in the art to which it pertains to understand and practice it, and having identified the presently preferred embodiment thereof, I claim:

1. In combination with apparatus for producing continuous form stationery by folding a strip of paper along transverse lines of weakening formed therein, said apparatus including, a frame, an oscillating chute mounted on said frame for alternately distributing said successive lines of weakening in said paper in substantially opposite directions, rollers carried on said frame for dispensing said continuous strip of paper into said oscillating chute, folding means carried on said frame and operatively associated with said oscillating chute for urging said paper distributed by said chute into a folded condition, said folding means including, spirals shaped and dimensioned to receive and carry away from said oscillating chute creased edges of paper distributed by said chute, said spirals being independently adjustable prior to the operation of said apparatus, beaters for periodically tamping said paper distributed by said chute, said beaters assisting in the folding and positioning of said paper and being independently adjustable prior to the operation of said apparatus, said spirals and beaters moving in synchronous relationship with said chute during the operation of said apparatus, a support surface for receiving paper dispensed by said spirals and beaters, paper stops positioned above said support surface, each of said paper stops having at least one upstanding face for stopping the lateral travel of creased edges of paper distributed by said chute, gear train means for transmitting motive power to said rollers, oscillating chute, and folding means such that generally synchronized movement thereinbetween is maintained, a portion of said gear train means actuating said chute and said folding means, said portion actuating said chute and folding means without actuating said rollers, power means to drive said gear train means, means for simultaneously adjusting said oscillating chute and said folding means in relation to said rollers while maintaining said generally synchronous movement between said chute and folding means, said adjustment means including, (a) at least one drive shaft positioned along said gear train means and transmitting motive power to said portion of said gear train means actuating said oscillating chute and said folding means, said drive shaft having a first segment and a second segment, and (b) a differential unit positioned along and interconnecting said first shaft segment and said second shaft segment for rotating said first shaft with respect to said second shaft so that said synchronous movement of said oscillating chute and said folding means may be adjusted in relation to said rollers when (i) said oscillating chute and said folding means are in motion during operation of said continuous form stationery folding apparatus, and (ii) said oscillating chute and folding means are idle prior to said power means being actuated to provide motive power to operate said continuous form stationery folding apparatus, said first and second shafts each carrying at least one component of said differential unit.

* * * * *